US005164633A

United States Patent [19]

Kim et al.

[11] Patent Number: 5,164,633

[45] Date of Patent: Nov. 17, 1992

[54] PLASMA DISPLAY PANEL WITH ARC-SHAPED CATHODES

[75] Inventors: Dae-il Kim, Kyunggi; Kyeong-min Kim, Seoul, both of Rep. of Korea

[73] Assignee: Samsung Electron Devices Co., Ltd., Kyunggi, Rep. of Korea

[21] Appl. No.: 725,087

[22] Filed: Jul. 3, 1991

[30] Foreign Application Priority Data

Jul. 4, 1990 [KR] Rep. of Korea ..... 90-10095

[51] Int. Cl.[5] ..... H01J 17/58

[52] U.S. Cl. ..... 313/581; 313/584; 313/586

[58] Field of Search ..... 313/581, 582, 584, 585, 313/609, 621, 632, 590, 484, 586, 587; 315/169.4

[56] References Cited

U.S. PATENT DOCUMENTS 3,755,027 8/1973 Gilsing ..... 313/584

4,554,482 11/1985 Kamegaya et al. ..... 313/582

*Primary Examiner*—Donald J. Yusko

*Assistant Examiner*—Michael Horabik

*Attorney, Agent, or Firm*—Cushman, Darby & Cushman

[57] ABSTRACT

A direct current plasma display device (PDP) includes two plates and a plurality of parallel anodes and parallel cathodes arranged on an inner surface of two plates, respectively. Grooves of a predetermined depth are provided on the rear plate and metallic cathodes are formed on the bottom surfaces of the grooves. This cathode structure results in a PDP having a low discharge maintaining voltage and a high cathode current density.

1 Claim, 2 Drawing Sheets

PLASMA DISPLAY PANEL WITH ARC-SHAPED CATHODES

BACKGROUND OF THE INVENTION

The present invention relates to a plasma display panel and more particularly to a direct current plasma display panel having a low discharge sustaining voltage.

As shown in FIG. 1, in a known direct current plasma display panel (hereinafter referred to as a PDP), a plurality of parallel anodes A and parallel cathodes K are arranged on, inner surfaces of two parallel plates 1 and 2 respectively. Barrier ribs B of a predetermined height are provided between anodes A on the upper plate to prevent a cross-talk. When plates 1 and 2 are positioned, anodes A and cathodes K are perpendicular to each other. In such a PDP the anodes A and the cathodes K are exposed to the inner space; which is filled with a discharge gas, so that a direct current discharge occurs between cathodes K on the lower plate and anodes A on the upper plate, i.e., at each pixel, due to the direct current voltage individually applied to the matrix of cathodes and anodes.

One disadvantage of this conventional PDP is the relatively large volume of the barrier rib, as compared to the volume of each discharge portion. Large energy losses occur as a result of this condition. In a PDP of high density and high resolution, the pixel size becomes extremely small. However, decreasing the size of the barrier rib is not practical, thereby enhancing large energy losses in PDP's of high density and high resolution. As a result, in the conventional PDP, the required discharge maintaining voltage is high, thereby, undesireably, increasing the consumed power.

SUMMARY OF THE INVENTION

It is an object of the present invention to provide a plasma display panel having a low discharge maintaining voltage and a high cathode current density.

To achieve the object of the present invention, the plasma display panel comprises a front plate provided with a plurality of parallel anodes and a rear plate provided with a plurality of parallel cathodes. When the plates are positioned, the cathodes are perpendicular to the anodes.

Grooves of a predetermined depth are provided on the rear plate. The cathodes are formed on the bottom surfaces of the grooves, so that the cathodes form elongated, arc-bottomed troughs, thereby increasing the discharge area for each pixel.

The plasma display panel of the present invention maximizes the area of the cathode, so that the discharge efficiency is greatly improved over that of the conventional one and the advantages of the hollow cathode discharge are obtained. Since the cathode operates within the negative glow region, the number of the metastable photons increases, thereby increasing the secondary electron emission. Also, the number of the electron collisions increases, thereby increasing the ionization and excitation. Accordingly, during plasma discharge, the voltage needed to continuously maintain the plasma discharge is relatively low as compared to a conventional plasma display panel. Thus, it has an advantage in that the cathode current is improved, within an identical discharge voltage range, over the conventional plasma display panel.

BRIEF DESCRIPTION OF THE DRAWINGS

The above object and other advantages of the present invention will become more apparent by describing the preferred embodiment of the present invention with reference to the attached drawings, in which.

DETAILED DESCRIPTION OF THE INVENTION

Figure 1:
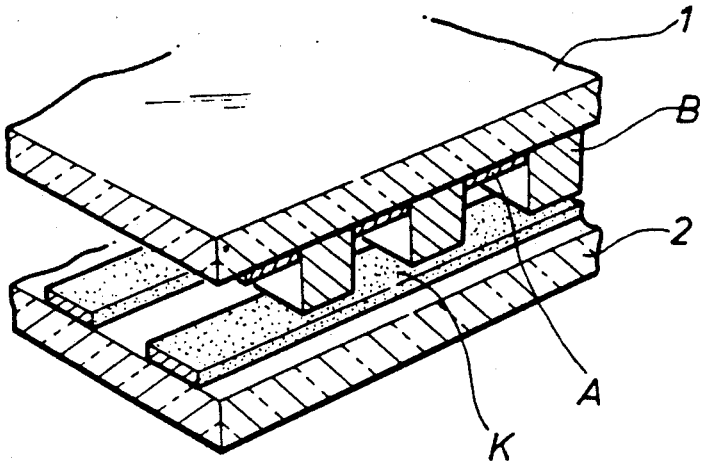
FIG.1(PRIOR ART)
FIG. 1 is a cutaway view of a segment of a conventional plasma display panel.
Figure 2:
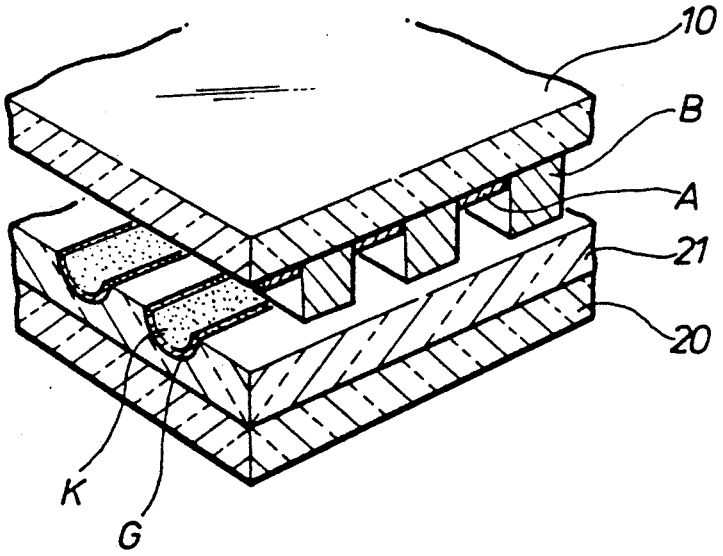
FIG. 2 is a cutaway view of a segment of the plasma display panel according to the present invention.
Figure 3:
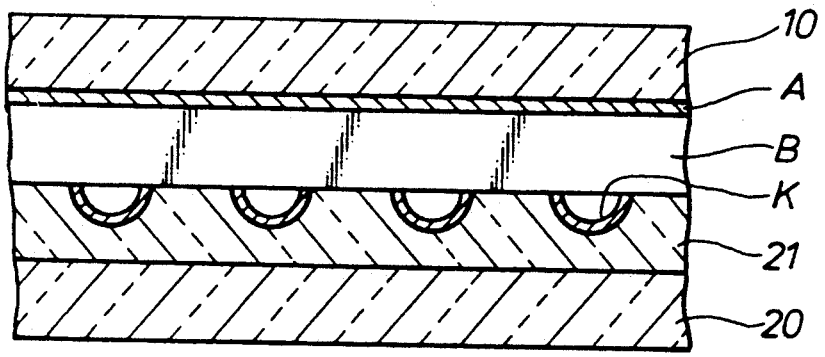
FIG. 3 is a sectional view taken from the front of the plasma display panel of the present invention shown in FIG. 2.

FIG. 2 shows a direct current PDP according to the present invention.

A plurality of anodes A and cathodes K are crossed in to form an X-Y matrix on a front plate 10 and a rear plate 20, respectively. The plates are spaced from each other at a predetermined gap. Barrier ribs B are formed to a predetermined height and located between the anodes A.

The cathodes K of the present invention are preferably U-shaped in cross-section. Grooves G can also have other cross-sectional shapes such as a "V" shape or a cylinder shape. Each cathode K is formed on the whole bottom surface of grooves G, which are formed in rear plate 20 and have a shape corresponding to the desired cathode shape. The grooves G are preferably formed on an insulating layer 21 of a predetermined thickness that is formed on the rear plate 20, as illustrated.

In the plasma display panel of the present invention, having the structure described above, the hollowed cathode that results is capable of the hollow cathode discharge. A negative glow is thereby created in the space enclosed by the cathode. Compared to the conventional planar cathode, discharge characteristics such as the low plasma discharge maintaining voltage, high current density, and negative I–V characteristics are all preferable using the cathode structure described above.

In the plasma display panel of the present invention as described above, the cathode on the rear plate is manufactured as follows.

The grooves G are formed on the rear plate 20, perpendicular to the cathodes A. The grooves G may be directly formed on the rear plate 20, but are preferably formed on an insulating layer 21 of a predetermined thickness previously discussed on the rear plate 20. Etching the insulating layer to form the grooves G then takes place. Consideration should be given to the desired difficulty of processing and the needed strength of the rear plate 20 when making such grooves G.

A metallic film is then formed on the whole surface of the insulating layer 21 having the grooves G by a conventional method, such as a chemical vapor deposition or thermal evaporation. A material having a tolerance for discharge gas should be used as the material for cathodes K. For instance, if the discharge gas contains mercury, a nickel paste which does not form an amalgam with the mercury can be used.

Subsequent to the metallic deposition, the metallic layer formed on the surface of the insulating layer 21, except grooves G, is polished and removed, so that the cathodes K which extend along the grooves G in the parallel, longitudinal direction, form elongated arc-bottomed troughs.

The fabrication method as described above is a part of a method for manufacturing an entire plasma display panel and the other processing steps occur before and after the cathode formation process in the process.

While the invention has been described in connection with what is presently considered to be the most practical and preferred embodiments, it is understood that the invention is not limited to the disclosed embodiment, but, on the contrary, is intended to cover various modifications and equivalent arrangements included within the spirit and scope of the appended claims.

What is claimed is:

1. A plasma display panel comprising:

a front plate having an inner surface on which a plurality of parallel anodes are arranged;

a rear plate having an inner surface on which an insulating layer is deposited, said insulating layer having a plurality of parallel grooves arranged perpendicular to said anodes, and each of said grooves comprising an elongated arc-bottomed trough, arranged perpendicular to said anodes;

a plurality of parallel strip-shaped cathodes being formed of metallic material, each of said cathodes individually formed on the bottom of each of said grooves, thereby each of said cathodes having an arc-shaped cross section; and a plurality of spaced barrier ribs disposed between said front and rear plates, thereby resulting in the positioning of said plurality of anodes perpendicular to said plurality of cathodes.

* * * * *